US007686395B2

(12) United States Patent
Piretti

(10) Patent No.: US 7,686,395 B2
(45) Date of Patent: Mar. 30, 2010

(54) CHAIR WITH DEFORMABLE BACKREST

(75) Inventor: Giancarlo Piretti, Bologna (IT)

(73) Assignee: Pro-Cord Spa, Bologna (IT)

( * ) Notice: Subject to any disclaimer, the term of this patent is extended or adjusted under 35 U.S.C. 154(b) by 0 days.

(21) Appl. No.: 12/024,943

(22) Filed: Feb. 1, 2008

(65) Prior Publication Data

US 2008/0185890 A1 Aug. 7, 2008

(30) Foreign Application Priority Data

Feb. 1, 2007 (EP) ..... 07425056

(51) Int. Cl.
*A47C 5/12* (2006.01)

(52) U.S. Cl. ..... 297/297; 297/301.1; 297/452.15

(58) Field of Classification Search ..... 297/296, 297/297, 285, 452.29, 452.31, DIG. 2, 452.39, 297/452.54, 452.55, 452.56, 450.1, 445.1, 297/452.15, 452.36, 452.33, 448.1, 451.1
See application file for complete search history.

(56) References Cited

U.S. PATENT DOCUMENTS

| | | | | |
|---|---|---|---|---|
| 3,512,831 | A * | 5/1970 | Flint | 297/309 |
| 3,942,836 | A * | 3/1976 | Baker | 297/451.1 |
| 4,305,617 | A * | 12/1981 | Benoit | 297/448.2 |
| 4,549,764 | A | 10/1985 | Haedo | |
| 4,733,910 | A * | 3/1988 | Brennan | 297/285 |
| 4,869,552 | A * | 9/1989 | Tolleson et al. | 297/296 |
| 5,697,673 | A * | 12/1997 | Favaretto | 297/301.1 |
| 5,904,397 | A * | 5/1999 | Fismen | 297/291 |
| 6,109,696 | A * | 8/2000 | Newhouse et al. | 297/452.1 |
| 6,250,718 | B1 * | 6/2001 | Newhouse et al. | 297/452.1 |
| 6,669,301 | B1 | 12/2003 | Funk et al. | |
| 6,739,663 | B2 * | 5/2004 | Gevaert | 297/296 |
| 6,786,548 | B2 * | 9/2004 | Heidmann et al. | 297/316 |
| 2002/0117883 | A1 | 8/2002 | Gevaert | |
| 2003/0164635 | A1 * | 9/2003 | Battey et al. | 297/299 |
| 2005/0161990 | A1 * | 7/2005 | Piretti | 297/285 |

FOREIGN PATENT DOCUMENTS

| | | |
|---|---|---|
| DE | 415483 | 6/1925 |
| DE | 1 264 002 | 3/1968 |
| DE | 298 24 476 | 5/1998 |
| EP | A-1557115 | 7/2005 |

OTHER PUBLICATIONS

EP Search Report, Application No. 07425056.4-1258, dated Jun. 25, 2007.

* cited by examiner

*Primary Examiner*—David Dunn
*Assistant Examiner*—Patrick Lynch
(74) *Attorney, Agent, or Firm*—Patterson & Sheridan, L.L.P.

(57) ABSTRACT

A chair comprising a supporting structure having a seat and a backrest, in which the backrest comprises a deformable resting portion made of plastic material which has a non-planar resting surface provided with at least one weakened area which enables an elastic deformation of the resting portion so that the resting portion assumes a configuration bent backwards under the action of a thrust applied backwards by the user, two uprights formed integrally on the lateral sides of the resting portion, and two side connection elements, which connect the backrest to the supporting structure, formed integrally at the bottom ends of the uprights. The backrest is provided with elastic stiffening elements made of a material different from the material constituting the resting portion and arranged only in an area corresponding to the uprights so as to bestow upon said uprights a rigidity to bending higher than that of the resting portion.

8 Claims, 5 Drawing Sheets

CHAIR WITH DEFORMABLE BACKREST

CROSS-REFERENCE TO RELATED APPLICATIONS

This application claims benefit of European patent application serial number 07425056.4, filed Feb. 1, 2007, which is herein incorporated by reference.

BACKGROUND OF THE INVENTION

1. Field of the Invention

The present invention relates to a chair comprising a supporting structure having a seat and a backrest, in which the backrest comprises:

a deformable resting portion made of plastic material having a non-planar resting surface and provided with at least one weakened area that enables elastic deformation of the resting portion so that the resting portion assumes a configuration bent backwards under the action of a thrust applied backwards by the user;

two uprights formed integrally on the lateral sides of the resting portion; and two side connection elements that connect the backrest to the supporting structure and are formed integrally at the bottom ends of the uprights.

2. Description of the Related Art

A chair of this type is known from the document No. EP-A-1557115, filed in the name of the present applicant. In the prior art chair, the backwards inclination of the backrest consists in part of an elastic deformation of the resting portion of the backrest and in part of a movement or a deformation of the connection elements that connect the backrest to the supporting structure. The resting portion and the side uprights of the backrest are made of a single injection-moulded plastic material. In the prior art chair, it is important to use for the production of the backrest a plastic material with good characteristics of rigidity in order to ensure the return of the backrest in the undeformed position when the thrust applied backwards by the user ceases. The plastic material used for the production of the backrest must moreover ensure that the backrest exerts a sufficient elastic thrust on the back of the user in the deformed position, given that the elastic reaction of the backrest has a marked impact from the standpoint of comfort.

To meet the aforesaid needs, the chair known from the document No. EP-A-1557115 must be made of a plastic material with high elastic properties, for example nylon.

To reduce the cost of production of the chair, it would be desirable to use a less costly plastic material, for example polypropylene. However, a less costly plastic material, such as for example polypropylene, would not present the elastic properties sufficient for guaranteeing proper operation of the backrest and the desired characteristics of comfort.

U.S. Pat. No. 6,669,301 discloses a chair comprising a seat and a backrest, both formed by a panel made of flexible plastic material, preferably polypropylene. The panel constituting the seat or the backrest is provided with a plurality of weakened areas constituted by through cuts. The panel comprises a continuous perimetral frame made of a second plastic material with a higher rigidity than that of the material constituting the panel. However, the continuous perimetral frame prevents the backrest from assuming a configuration bent backwards under the action of a thrust applied backwards by the user.

The purpose of the present invention is to provide a simple and inexpensive chair that will overcome the drawbacks of the prior art.

SUMMARY OF THE INVENTION

According to the present invention, said purpose is achieved by a chair having the characteristics forming the subject of Claim 1.

BRIEF DESCRIPTION OF THE DRAWINGS

The present invention will now be described in detail with reference to the attached drawings, provided purely by way of non-limiting example, in which.

Figure 1:
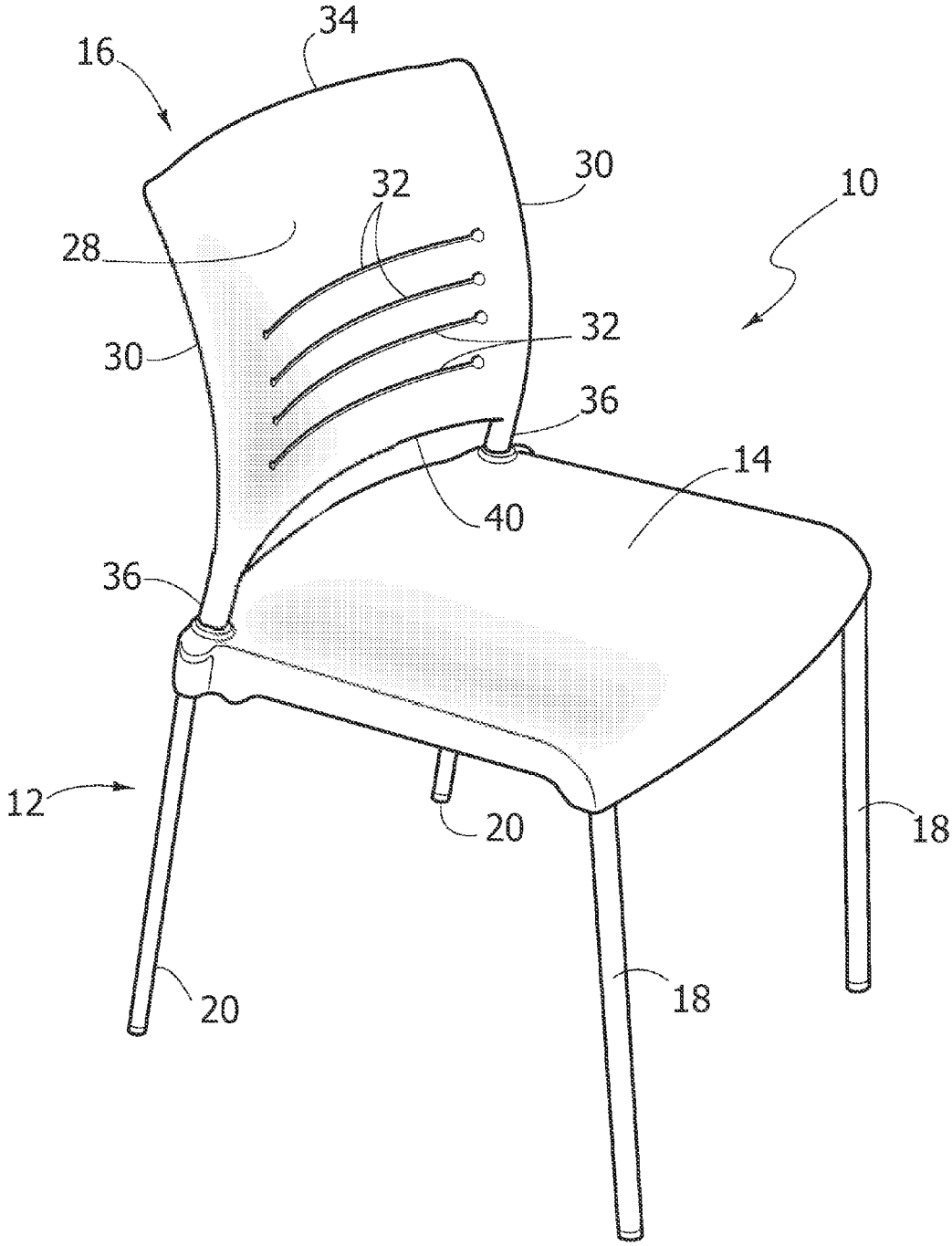
FIG. 1 is a perspective view of a chair according to the present invention.
Figure 2:
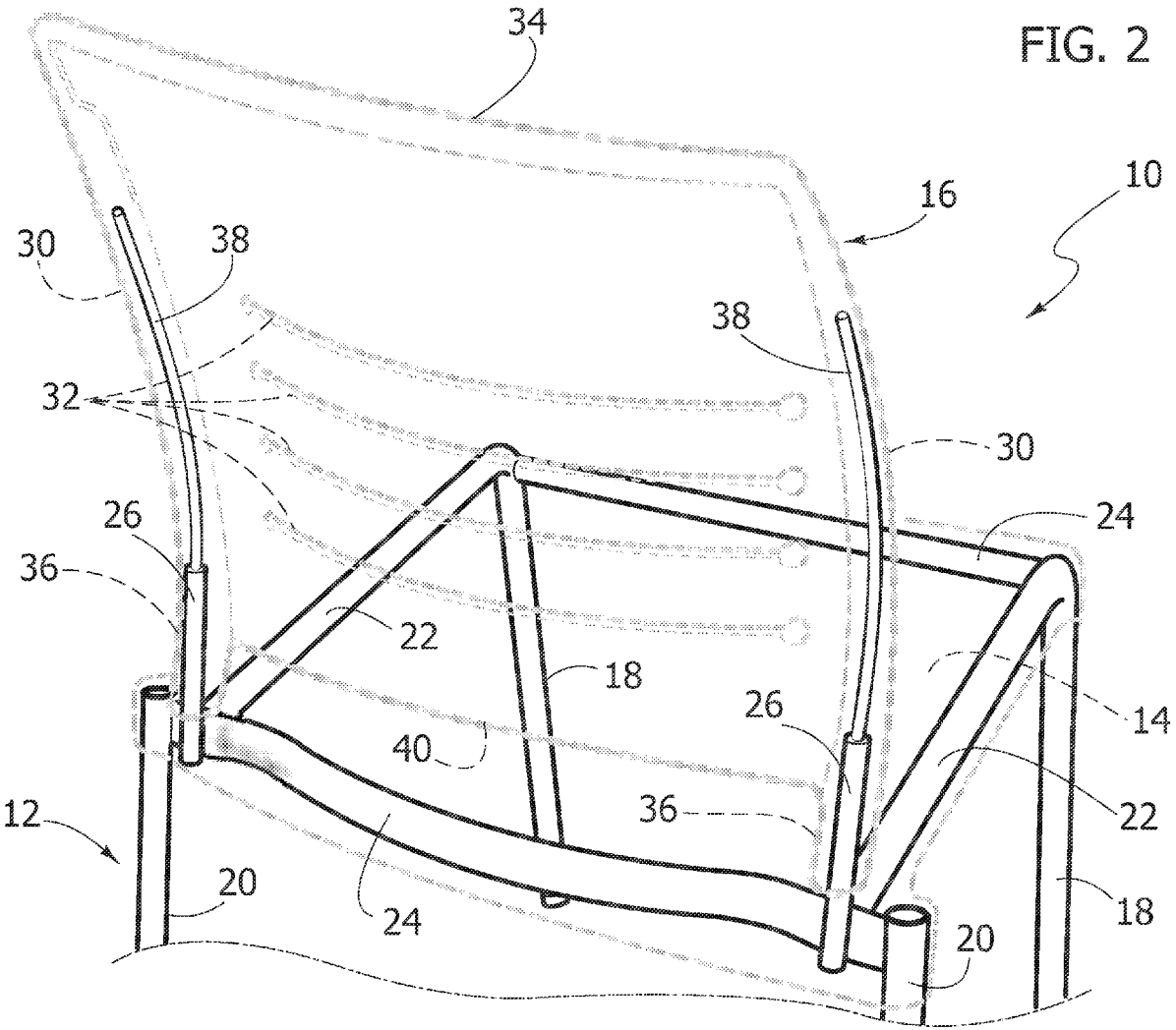
FIG. 2 is a rear perspective view of the chair of FIG. 1, with the seat and the backrest represented in transparency.
Figure 3:
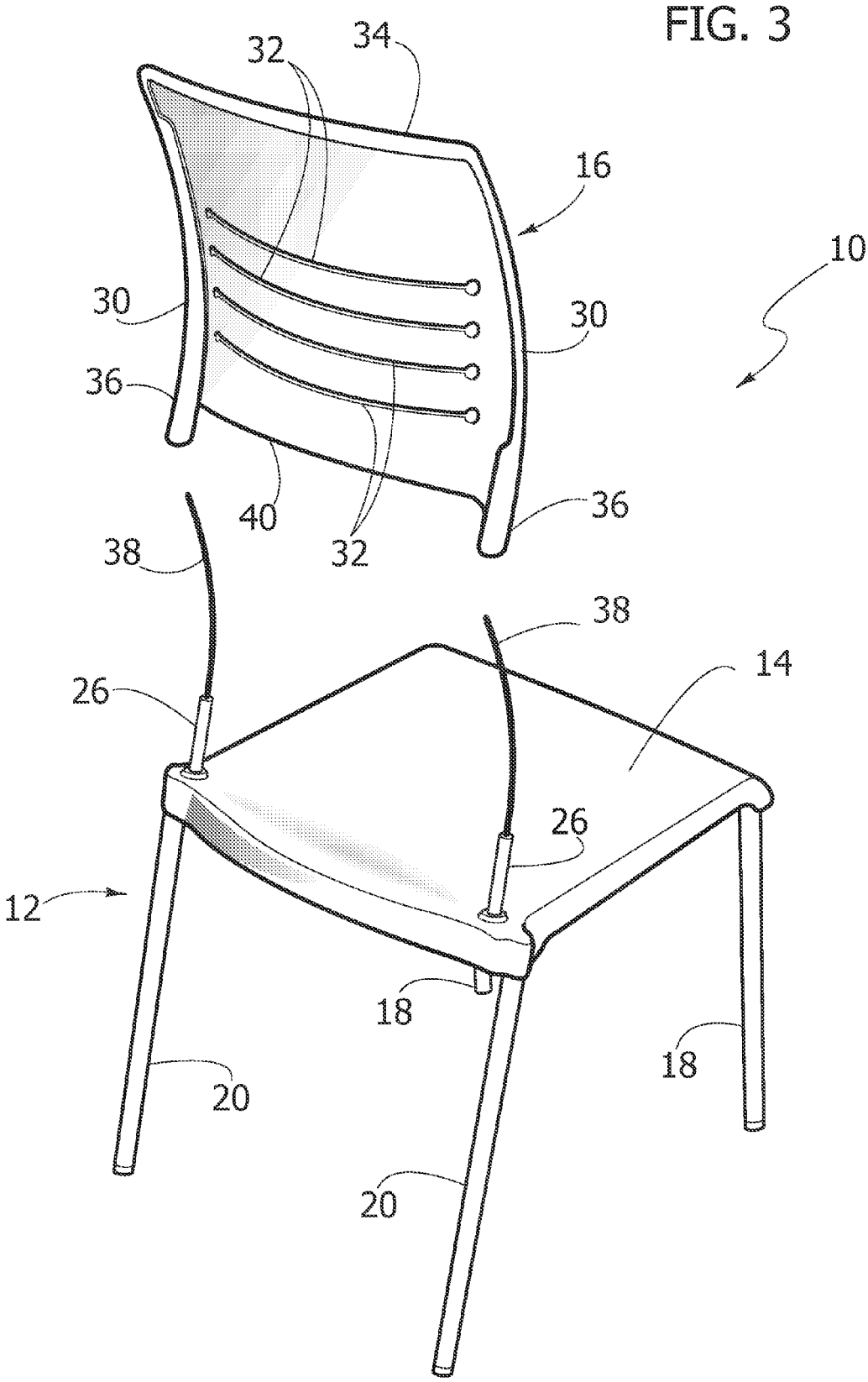
FIG. 3 is a partially exploded perspective view of the chair according to the present invention.
Figure 4:
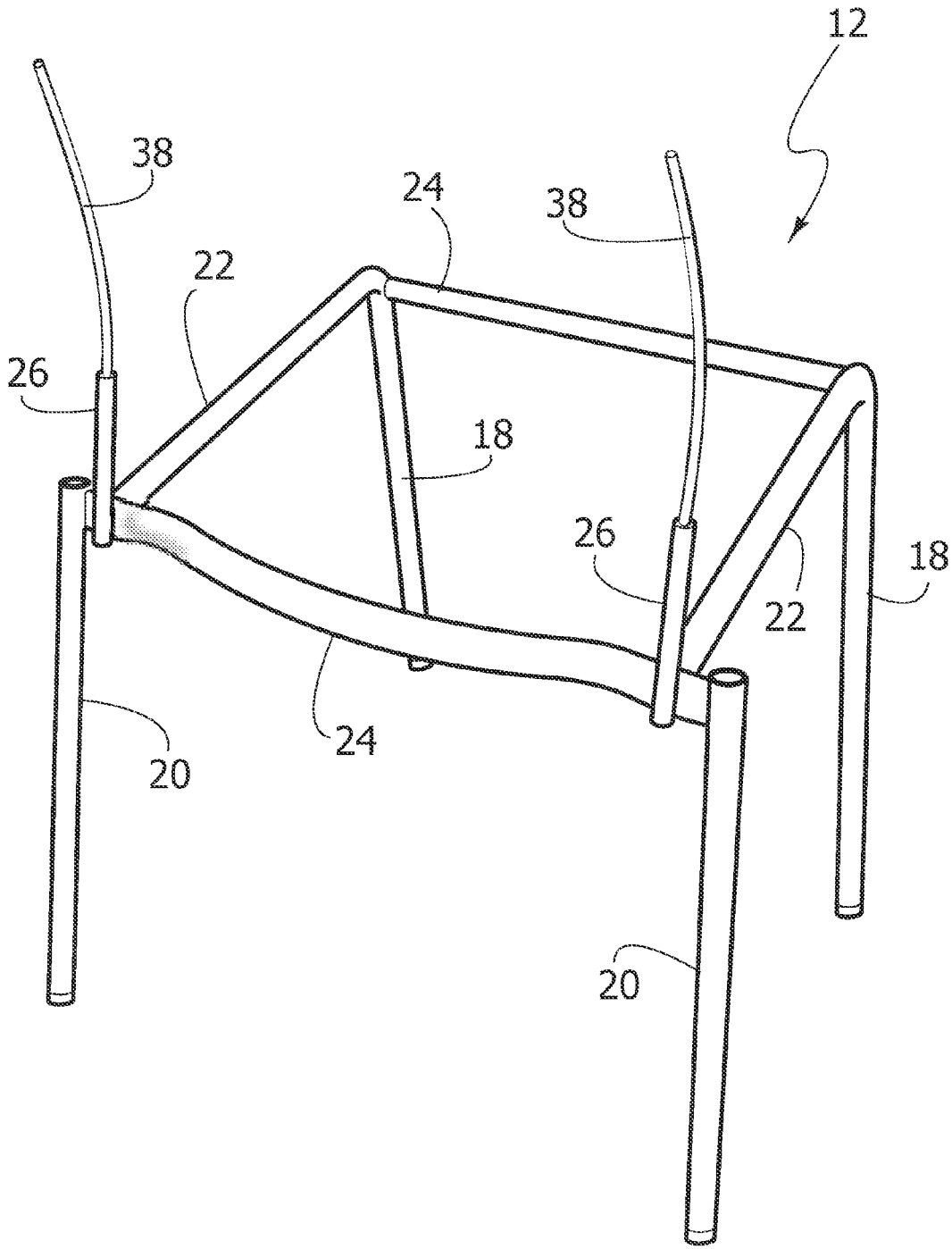
FIG. 4 is a perspective view illustrating the supporting structure of the chair according to the present invention.

With reference to the figures, designated by 10 is a chair according to the present invention. The chair 10 comprises a supporting structure 12 having a seat 14 and a backrest 16.

DETAILED DESCRIPTION

In the embodiment of the invention illustrated in the figures, the supporting structure 12 comprises two front legs 18 and two rear legs 20, joined to one another at their tops by a substantially quadrangular frame formed by a pair of longitudinal elements 22 and by a pair of transverse elements 24. The basic structure 12 is preferably made up of tubular metal elements, bent and welded. The present invention is not, however, limited to the embodiment of the supporting structure 12 illustrated by way of example in the figures. The invention may be applied to chairs provided with a supporting structure of any shape.

The supporting structure 12 comprises two tubular supporting members 26, which extend upwards starting from the rear transverse element 24. The tubular supporting members 26 are fixed at their bottom ends to the rear transverse element 24 and are situated in an area corresponding to the two longitudinal elements 22.

In the embodiment illustrated in the figures, the seat 14 is constituted by a body made in a single piece of injection-moulded plastic material, fixed to the top part of the supporting structure 12. The rear part of the seat 14 is preferably provided with two holes, through which said tubular supporting members 26 extend.

The backrest 16 of the chair according to the present invention comprises a panel made of injection-moulded plastic material, preferably polypropylene. The backrest 16 comprises a deformable resting portion 28 and two uprights 30 formed integrally on the lateral sides of the resting portion 28. The resting portion 28 of the backrest 16 has a non-planar resting surface facing the front part of the chair. The resting surface is preferably provided with a curvature both in a horizontal plane and in a vertical plane. In a cross section in a horizontal plane, the resting surface has its own concavity facing the front part of the chair. In a cross section in a vertical plane, the resting surface has its own convexity facing the front part of the chair.

The resting portion 28 of the backrest 16 is provided with a plurality of weakened areas 32, which have the purpose of rendering the backrest 16 elastically deformable. In the example illustrated, the weakened areas 32 are constituted by through cuts parallel to one another, which extend in a transverse direction through a substantial part of the width of the resting portion 28. Alternatively, the weakened areas 32 can be constituted by non-through grooves with a reduced thickness with respect to the remaining part of the resting portion 28. Each of the weakened areas 32 can be continuous, as illustrated in the figures, or else formed by two or more stretches separated from one another by non-weakened areas.

The weakened areas 32 enable a deformation backwards of the resting portion 28 of the backrest 16 under the action of a thrust applied backwards by the user. Under the action of said thrust, the top edge 34 of the backrest 16 is displaced backwards with respect to the undeformed configuration of the backrest. The weakened areas 32 also define the position of maximum inclination backwards of the backrest 16. Said position is in fact defined by the condition in which the top edges and the bottom edges of the weakened areas 32 come into contact with one another. By varying the height and the number of the weakened areas 32 it is possible to vary the angle of maximum inclination backwards of the backrest 16.

The backrest 16 comprises two side connection elements 36 formed integrally at the bottom ends of the uprights 30. The two side connection elements 36 have a tubular shape and are coupled to the upward-projecting portions of the supporting members 26 of the supporting structure 12. The coupling between the supporting members 26 and the connection elements 36 enables fixing of the backrest 16 to the supporting structure 12. Said fixing can be completed by means of transverse screws (not illustrated) or else by means of plastic deformation (crimping) of a portion of the connection elements 36 on the tubular supporting members 26.

According to the present invention, the backrest 16 is provided with elastic elements 38 that bestow upon the uprights 30 a rigidity to bending higher than that of the resting portion 28. The elastic elements 38 constitute a localized stiffening of the backrest 16, provided only in an area corresponding to the side uprights 30. The remaining part of the resting portion 28 of the backrest 16 is without additional stiffening elements. In particular, the top edge 34 and the bottom edge 40 of the resting portion 28 are without any stiffening.

The elastic stiffening elements 38 are made of a material different from the material constituting the resting portion 28 of the backrest 16. The elastic elements 38 may be components that can be separated from the resting portion 28 or else may be permanently integrated in the structure of the backrest 16.

Figure 5:
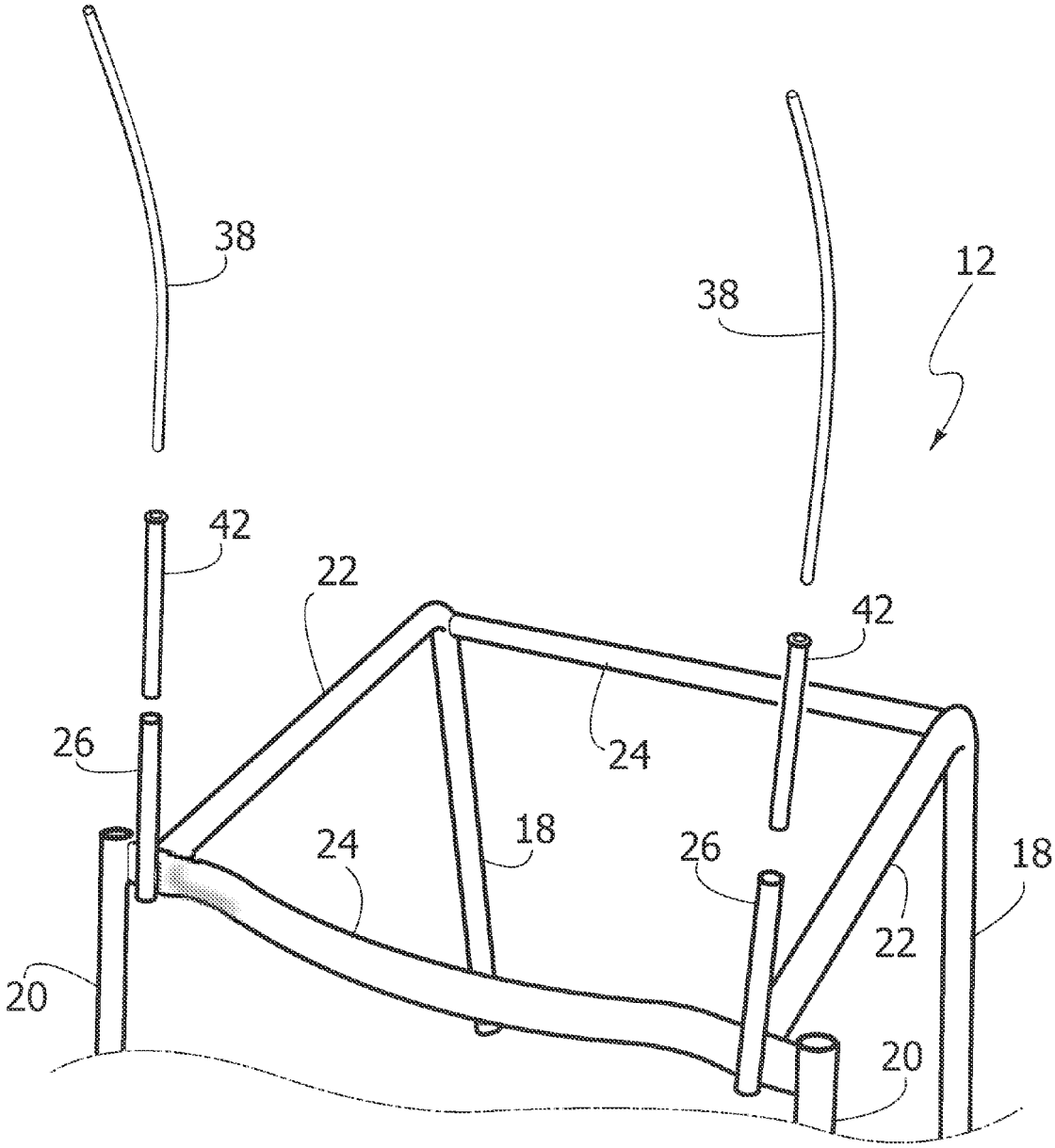
FIG. 5 is an exploded perspective view of the part illustrated in FIG. 4.

According to a preferred embodiment of the present invention, the elastic elements are formed by two rods 38 of spring steel having at rest a pre-set curvature that approximates the curvature of the uprights 30. Each elastic element 38 has a bottom end portion that is inserted in a respective tubular supporting member 26. Preferably, a bushing made of plastic material 42 (FIG. 5) is set between the bottom end portion of each elastic element 38 and the internal wall of the respective tubular supporting member 26. The elastic elements 38 project upwards from the respective supporting members 26 and engage respective seats formed within the uprights 30.

The seat 14 can be fixed to the supporting structure 12 before or after insertion of the elastic elements 38 in the respective tubular supporting members 26. Preferably, the curvature of the elastic elements 38 is less than that of the seats provided within the uprights 30. This means that, during insertion of the backrest on the elastic elements 38, the elastic elements 38 are pre-loaded so that the backrest is subject at rest to a force that opposes the bending backwards.

The elastic elements 38 bestow a greater rigidity upon the backrest, concentrated in an area corresponding to the uprights 30. This increase of localized rigidity enables use, for fabrication of the backrest 16, of a plastic material having lower elastic characteristics and a lower cost (for example, polypropylene).

In the embodiment illustrated in the figures, the elastic elements 38 are components separate from the backrest 16, and the backrest is made of a single plastic material. This embodiment renders the chair according to the present invention completely recyclable, since the components made of plastic material can be separated from the metal components. Alternatively, the elastic elements 38 could be integrated permanently in the structure of the backrest 16, for example by means of co-moulding. According to a further variant of the present invention, the elastic elements 38 could be formed by portions made of plastic material with greater rigidity overmoulded or co-moulded in an area corresponding to the side uprights 30 of the backrest 16.

While the foregoing is directed to embodiments of the present invention, other and further embodiments of the invention may be devised without departing from the basic scope thereof, and the scope thereof is determined by the claims that follow.

The invention claimed is:

1. A chair comprising a supporting structure configured to support a seat and a backrest, in which the backrest comprises:

a deformable resting portion made of plastic material, which has a non-planar resting surface and is provided with at least one weakened area, which enables an elastic deformation of the resting portion so that the resting portion assumes a configuration bent backwards under the action of a thrust applied backwards by the user, said weakened area having the shape of a line that extends in a transverse direction on said resting portion, two uprights formed integrally on the lateral sides of the resting portion, and two side connection elements formed integrally at the bottom ends of the uprights, wherein the two side connection elements have a tubular shape and are coupled to respective upwardly-projecting portions of tubular supporting members that are non-rotatably fixed to the supporting structure so as to cantilever the backrest to the supporting structure, said upwardly-projecting portions being inserted into corresponding cavities of said side connection elements, wherein elastic stiffening elements are inserted within cavities of the tubular supporting members such that they also extend within an area corresponding to the uprights for at least half a length of each of said uprights, said elastic stiffening elements providing to said uprights a rigidity to bending higher than that of the resting portion.

2. The chair according to claim 1, wherein said elastic elements comprise two metal rods inserted within respective seats formed within said uprights.

3. The chair according to claim 2, wherein said rods have a curvature at rest different from that of the respective seats, so as to apply on the backrest, in the undeformed condition, a force that opposes the bending backwards of the backrest.

4. The chair according to claim 3, wherein said metal rods have respective bottom portions inserted within said tubular supporting members.

5. The chair according to claim 4, wherein a bushing made of plastic material is set between the end portion of each of said metal rods and the respective tubular supporting member.

6. The chair according to claim 1, wherein said elastic stiffening elements are obtained by means of co-moulding or overmoulding of a plastic material with greater rigidity than the material constituting said resting portion.

7. The chair according to claim 1, wherein said at least one weakened area comprises at least one through slit.

8. The chair according to claim 1, wherein said at least one weakened area comprises at least one groove with reduced thickness.

* * * * *